US007740485B1

(12) United States Patent
Edwards, Jr.

(10) Patent No.: US 7,740,485 B1
(45) Date of Patent: Jun. 22, 2010

(54) ELECTRIC POWER INTERRUPT CONTROL

(76) Inventor: Russell J Edwards, Jr., 2748 Painted Leaf Dr., Crown Point, IN (US) 46307

( * ) Notice: Subject to any disclaimer, the term of this patent is extended or adjusted under 35 U.S.C. 154(b) by 0 days.

(21) Appl. No.: 12/380,818

(22) Filed: Mar. 5, 2009

(51) Int. Cl.
*H01R 33/00* (2006.01)

(52) U.S. Cl. ..... 439/34; 307/142; 200/61.08

(58) Field of Classification Search ..... 439/34, 439/35; 307/142; 200/61.08
See application file for complete search history.

(56) References Cited

U.S. PATENT DOCUMENTS

| | | | | |
|---|---|---|---|---|
| 7,052,282 | B2 * | 5/2006 | Meleck et al. | 439/34 |
| 7,241,146 | B1 * | 7/2007 | Kim et al. | 439/34 |
| 7,279,651 | B1 * | 10/2007 | Nguyen | 200/330 |
| 7,286,046 | B2 * | 10/2007 | Kinsey et al. | 340/431 |
| 7,431,601 | B2 * | 10/2008 | Nugent et al. | 439/188 |
| 7,484,689 | B2 * | 2/2009 | Musial et al. | 244/114 R |
| 7,687,935 | B2 * | 3/2010 | Bailey | 307/9.1 |
| 2004/0189099 | A1 * | 9/2004 | Wild | 307/80 |
| 2005/0098415 | A1 * | 5/2005 | Lee | 200/51.11 |
| 2007/0221370 | A1 * | 9/2007 | Allen et al. | 165/202 |
| 2007/0224843 | A1 * | 9/2007 | Kim et al. | 439/35 |
| 2008/0113522 | A1 * | 5/2008 | Wagner | 439/35 |
| 2008/0146058 | A1 * | 6/2008 | Nugent et al. | 439/159 |
| 2008/0157593 | A1 * | 7/2008 | Bax et al. | 307/10.1 |
| 2008/0158785 | A1 * | 7/2008 | Murray et al. | 361/622 |
| 2008/0164850 | A1 * | 7/2008 | Ayana et al. | 322/1 |
| 2009/0056354 | A1 * | 3/2009 | Davis et al. | 62/236 |

* cited by examiner

*Primary Examiner*—Ross N Gushi

(57) ABSTRACT

An apparatus, when in use, is connected to standby electrical power through a power cord. The apparatus controls the electrical power source to a transportation vehicle with an electrical control device. The electrical control device is energized by a switch. The switch is operated by attaching the transportation vehicle power cord by means of compression via two nylon ties. When tension is present on the transportation vehicle power cord the nylon ties will break. When the nylon ties break, the switch immediately de-energizes the electrical control device and the transportation vehicle power cord. If the transportation vehicle continues to pull on the transportation vehicle power cord, it will be in the de-energized mode. The transportation vehicle power cord will be pulled away from the apparatus and away from the electrical connections through a water tight grip.

1 Claim, 4 Drawing Sheets

ELECTRIC POWER INTERRUPT CONTROL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to electrical connectors and more particularly to an electrical power interrupt control device which is capable of automatically interrupting the flow of current through a power line which is connected to a vehicle.

Transportation vehicles such as refrigerated trucks, transport refrigerated units, boats, recreational vehicles and delivery tractor trailers typically utilize power lines which are connected to stand-by power sources while the vehicle is stationary or docked. This allows truck and boat operators to connect their vehicle while stopped and to use off-board power sources in order to operate on-board systems such as refrigeration, air conditioning and heating equipment, and other appliances of various type and application, without any engine idling.

There are existing problems which relate to the use of these off-board power sources. Before a vehicle operator can safely drive away or undock, the stand-by power must first be de-energized, and then the power line to the vehicle must be disconnected and stored. The problem as it relates is that, due to human error and judgment, many operators forget to de-energize and disconnect the power line before disembarking. When an operator disembarks without disconnecting the power line from the vehicle, this results in damage to any combination of the power cord, the flange inlet on the vehicle, the male plug and receptacle or the connector; more importantly, the power supplied to all these connecting electrical parts usually remains energized, which is a large safety hazard to unknowing individuals who may not realize the potential for electrocution upon contact with live parts.

The 2008 version of the National Electrical Code addressed this problem by requiring that "power supply cable (s) shall be provided with a means to de-energize the cable conductors and power service delivery device upon exposure to strain that could result in either cable damage or separation from the power service delivery device and exposure of live parts."

There is a continuing and mandated need for an apparatus capable of disconnecting power to a transportation vehicle power cord, so that current flow is interrupted to prevent problems such as electrocution and electrical fires. There is also a need to help prevent major damage to electrical equipment due to excessive stress placed upon the electrical wiring.

OBJECTS AND SUMMARY OF THE INVENTION

It is the object of the present invention to create a means to automatically disconnect electrical power to a transportation vehicle power cord when the cord is exposed to strain.

Another object of the present invention is to provide an automatic means of disconnecting electrical power to a transportation vehicle power cord prior to damage caused by stress placed upon the cord.

Another object of the present invention is to interrupt the flow of current in a transportation vehicle power cord prior to an operator's disembarkment while the transportation power cord is still physically connected to the electrical power source.

Another object of the present invention is to provide a weather tight connection so the apparatus and electrical power cord are sealed to prevent contamination.

Yet another object of the present invention is to comply with the National Electrical Code, and provide a weather proof housing and method to automatically interrupt current flow to a transportation vehicle power cord and connector.

Another object of the present invention is to provide an electrical power interruption control apparatus in which an interrupter switch is closed in the "on" position when the transportation vehicle power cord is not under stress, and opens to the "off" position when stress is placed upon the cord.

Yet another object of the present invention is to create an apparatus which comprises of a device using the fewest number of relatively simply component parts, resulting in reliable and long term operation.

The foregoing and other objects and advantages of the present invention will appear more clearly hereinafter.

In accordance with the present invention there is provided an electrical power interruption control apparatus which includes a sealed and weatherproof housing to which an electrical power cord and connector attached. During use, the electrical connector mates with an electrical connector which is part of the transportation vehicle. The electrical connector and cord are secured to the weatherproof housing by means of nylon ties which, when intact, compress a switch. The power cord continues to enter the weatherproof housing and connects to the electrical control device.

When the transportation vehicle power cord experiences any strain beyond reasonable use, the nylon ties which secure the cord to the housing will break. Upon occurrence of the nylon ties breaking, the power cord will fall away from the housing and the switch is released, whereby power to the electrical control device becomes de-energized. When the electrical control device is de-energized, power to the transportation vehicle power cord and connector is interrupted.

If the transportation vehicle continues to place strain upon its power cord and connector, they will be in a de-energized state. If the transportation vehicle power cord and connector become separated from the weatherproof housing, this cord and connector will experience less damage than would normally be expected.

The transportation vehicle power cord is connected to the weatherproof housing by means of a weather proof compression connector and push-on electrical terminals. This configuration allows disconnection and separation of the transportation vehicle power cord from the weatherproof housing and power connection terminals in a way that places far less strain on either the transportation vehicle power cord, the connector, and the electrical terminals that are connected to the electrical control device.

BRIEF DESCRIPTION OF THE DRAWINGS

Other important advantages of the invention will be apparent from the following four drawings that enhance the following detailed description of the invention.

The individual transportation vehicle power cord wires which will be located inside the weatherproof enclosure and will be connected to the T side of the electrical control device and ground.

Figure 1:
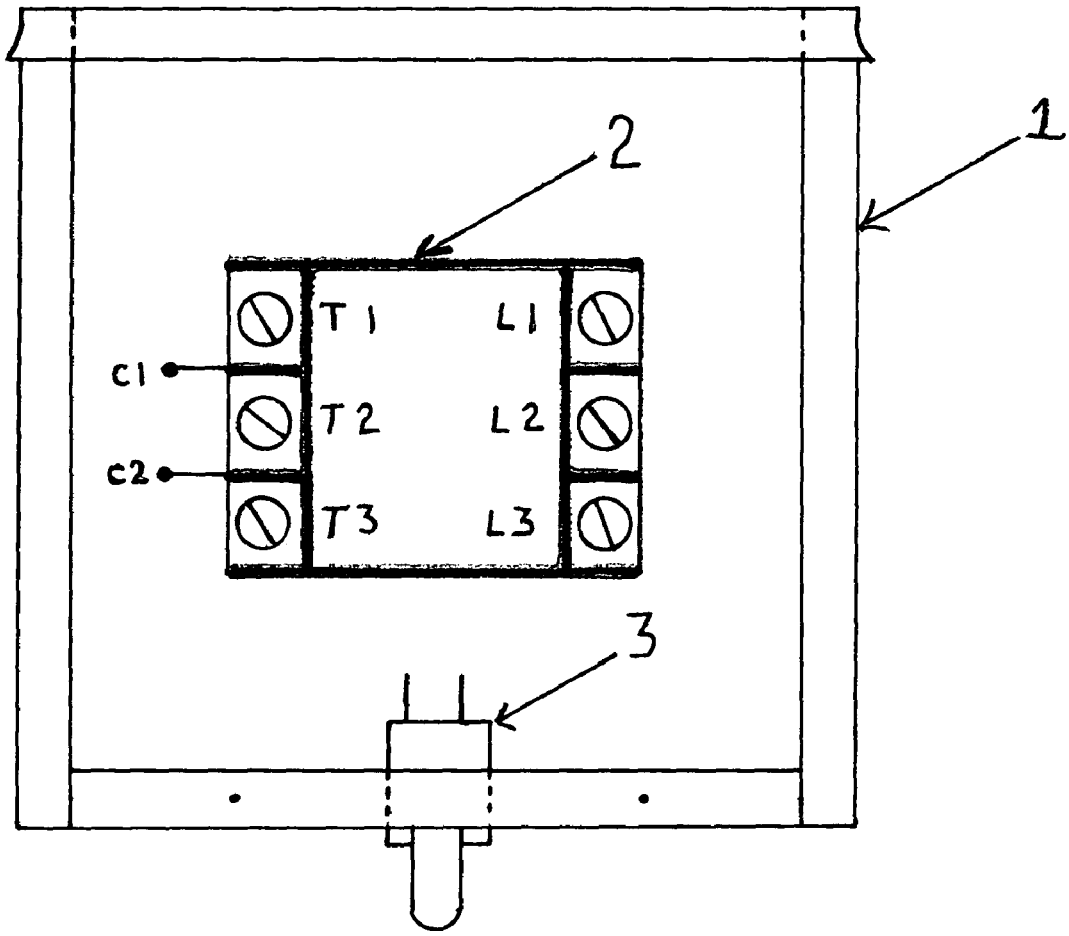
FIG. 1. is a perspective view of the Electric Power Interrupt Control, made in accordance with the invention, with the Electric Power Interrupt Control shown indicating the electrical control device and switching device. From a frontal view point.
Figure 2:
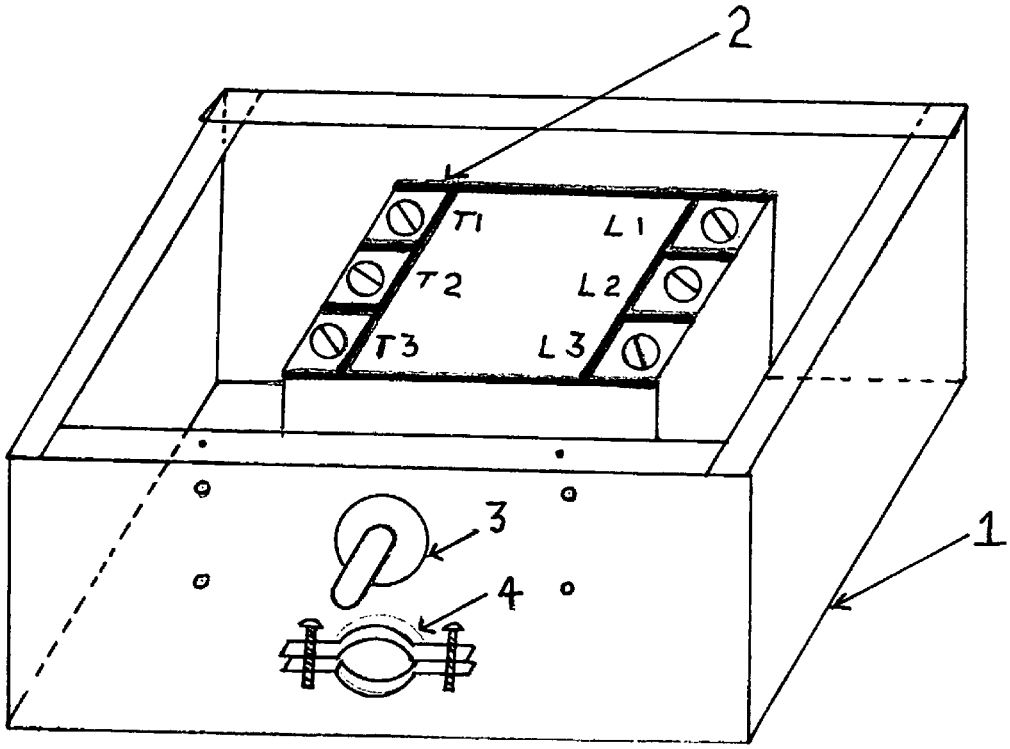
FIG. 2. is a three dimensional view showing the electrical control device, the switching device, the punched cutout holes indicating where the nylon ties will enter and exit in order to hold the power cord to the weather proof enclosure and the mechanical box connector which allows the power cord to enter the weatherproof enclosure in accordance with the National Electrical Code.
Figure 3:
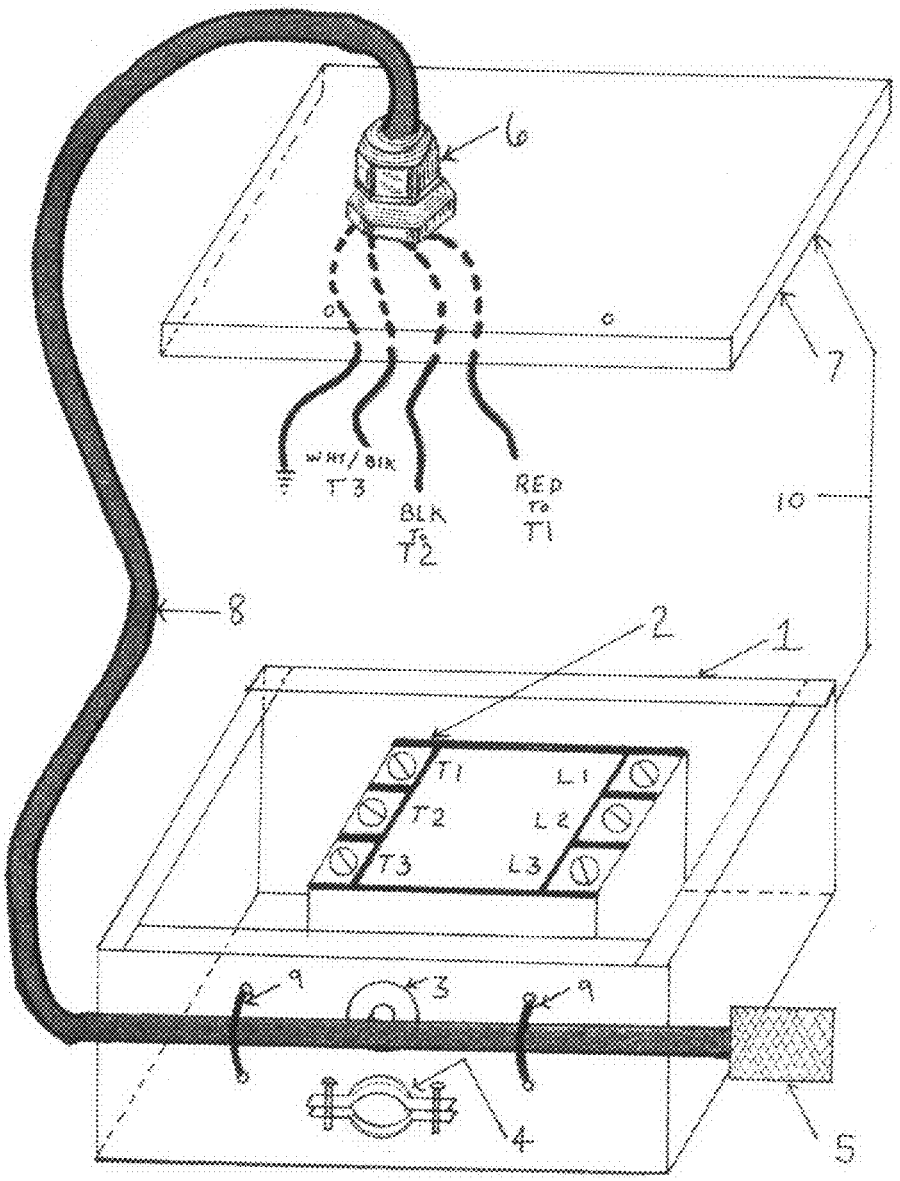
FIG. 3. is a three dimensional view showing all items in FIG. 2. including; the transportation vehicle power cord tied in place against the switching device with the use of nylon ties. The weather proof cover showing the weatherproof connector allowing the transportation vehicle power cord to enter the weather proof closure so contamination does not occur.
Figure 4:
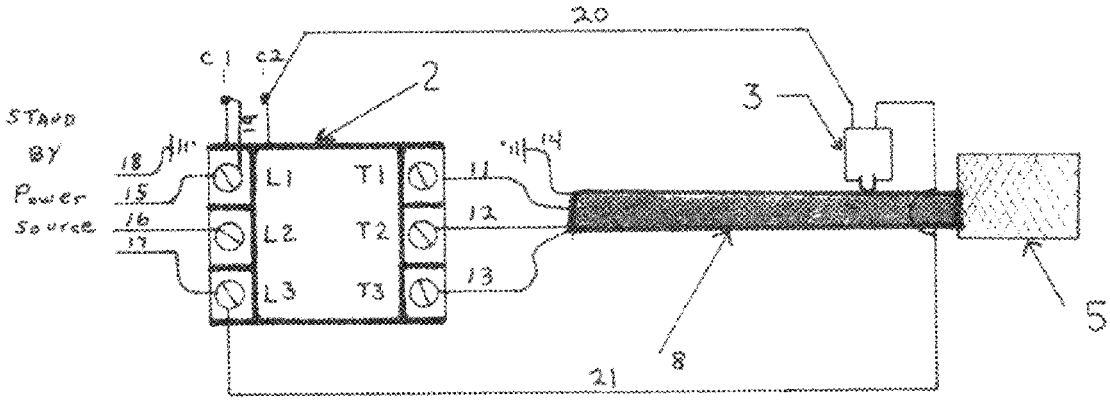

FIG. 4. is a pictorial block diagram of apparatus of FIG. 3.

DETAILED DESCRIPTION OF THE INVENTION

With reference to the drawings, wherein like reference numbers designate like or corresponding parts throughout, there is shown in FIGS. 1-4 an electric power interrupt control apparatus 10, which includes a weatherproof enclosure 1, a weatherproof cover 7 a transportation vehicle power cord 8, weatherproof box connector 6, and a power cord mechanical box connector 4.

Transportation vehicle power cord 8 is held in place against switching device 3 using two nylon ties 9. Transportation vehicle power cord 8 continues on and enters weatherproof enclosure 1 via transportation vehicle weather proof box connector 6. Wires 11,12,13 and 14 which are encased within transportation vehicle power cord 8 are connected to electrical control device 2 using pressure connectors at T1, T2, T3 and ground.

Standby electrical power enters weather proof enclosure 1, via power cord mechanical box connector 4. Wires 15, 16, 17 and 18 which are encased within a flexible power cord are connected at electrical control device 2, using pressure connectors at L1, L2, L3 and ground.

Wire 19 is connected at electrical control device 2, at C1 connection and electrical control device 2, at L1 connection. Wire 20 is connected between electrical control device 2, at C2 connection and switching device 3. Wire 21 is connected at electrical control device 2, at L3 connection and switching device 3. Wire 14 and 18 respectively are connected at electrical control device 2, ground connection.

When transportation vehicle power cord 8 is pushing in switching device 3 by means of compression and being held in this position with the use of nylon ties 9, the switching device 3 allows current to flow from electrical control device 2 at L3 connection to switching device 3 and on to C2 connection of electrical control device 2 resulting in a energized electrical coil for the electrical control device 2. When the electrical coil for the electrical control device 2 is energized, it creates a magnetic field allowing stand by power to be transferred mechanically from L1 to T1, from L2 to T2 and from L3 to T3 connections on the electrical control device.

This results in standby power to flow from the power source through the electrical control device 2 through transportation vehicle power cord 8 and ultimately transportation vehicle power cord female connector 5.

When movement of transportation vehicle places strain upon transportation power cord 8 resulting in strain upon nylon ties 9, nylon ties will break allowing transportation power cord 8 to fall free from switching device 3.

When power cord 8 falls free from switching device 3 the switching device is not depressed and held in position by transportation power cord 8.

In the non-depressed condition the switching device 3 prevents current flow from the standby power source at L3 to the C2 connection at electrical control device 2.

When there is no current flow from the L3 connection to the C2 connection on the electrical control device the magnetic field collapses, current is then interrupted between L1 to T1, L2 to T2 and L3 to T3 respectively. When there is no current present at T1, T2 and T3 at electrical control device 2, Transportation vehicle power cord female connector 5 become de-energized.

If the transportation vehicle continues movement, power cord 8 will experience more strain creating a pulling affect upon transportation vehicle power cord weather proof connector 6. The continued strain will cause transportation vehicle power cord 8 to be physically pulled out of transportation vehicle power cord weatherproof connector 6 and disconnection of wires 11, 12, 13 and 14 at electrical control device 2. Transportation vehicle power cord 8 and wires 11, 12, 13 and 14 are connected so they can be pulled away freely using push on electrical terminals resulting in less damage to either transportation vehicle power cord 8 transportation vehicle power cord female connector 5 weather proof enclosure 1 weather proof cover 7 or electrical control device 2.

The forgoing specific embodiment of the present invention as set forth in the specification herein, is for illustrative purposes only. Various deviations and modifications may be made within the spirit and scope of this invention, without departing from the main theme of the invention.

I claim:

1. An electric power disconnect apparatus of an external cord connected to said apparatus comprising:

a housing means;

a transportation vehicle power cord and weather proof box connector for connection of said external cord;

two nylon ties securing the transportation vehicle power cord in place, activating a switching device;

a switching device used for sensing proper transportation vehicle power cord positioning;

an electrical control device to disconnect power automatically from stand by power at L1, L2 and L3 connections to transportation vehicle power cord connections T1, T2 and T3.

* * * * *